US007770415B2

(12) United States Patent
Abramo

(10) Patent No.: US 7,770,415 B2
(45) Date of Patent: Aug. 10, 2010

(54) KNITTING DEVICE FOR MAKING A THICK DOUBLE-SIDED TEXTILE

(75) Inventor: Jacques Abramo, Huoblibachstrasse 14, 8808 Pfafflkon (CH)

(73) Assignee: Jacques Abramo, Pfaffikon (CH)

( * ) Notice: Subject to any disclaimer, the term of this patent is extended or adjusted under 35 U.S.C. 154(b) by 338 days.

(21) Appl. No.: 11/989,835

(22) PCT Filed: Jul. 28, 2006

(86) PCT No.: PCT/IB2006/002862

§ 371 (c)(1),
(2), (4) Date: Apr. 1, 2008

(87) PCT Pub. No.: WO2007/015172

PCT Pub. Date: Feb. 8, 2007

(65) Prior Publication Data

US 2010/0154482 A1 Jun. 24, 2010

(30) Foreign Application Priority Data

Aug. 1, 2005 (FR) ..... 05 08228

(51) Int. Cl.
*D04B 9/06* (2006.01)

(52) U.S. Cl. ..... 66/17; 66/19

(58) Field of Classification Search ..... 66/8, 66/17, 18, 20–28, 90–93
See application file for complete search history.

(56) References Cited

U.S. PATENT DOCUMENTS 5,422,153 A * 6/1995 Miyamoto ..... 428/95
6,105,401 A * 8/2000 Chadeyron et al. ..... 66/195
6,634,190 B2 * 10/2003 Didier-Laurent ..... 66/196
6,915,666 B2 * 7/2005 Willmer ..... 66/19
7,293,432 B2 * 11/2007 Jurgens ..... 66/93
2002/0152776 A1 * 10/2002 Didier Laurent ..... 66/196

(Continued)

FOREIGN PATENT DOCUMENTS

DE 31 40 787 A1 4/1983

(Continued)

OTHER PUBLICATIONS

Kowalski, K., et al. "Struktur and Eigenschaften Einer Neuen Gruppe Gestrickter Abstandstextilien." *Melliand Textilberichte*, vol. 5, pp. 384-387 (1999).

*Primary Examiner*—Danny Worrell
(74) *Attorney, Agent, or Firm*—Oliff & Berridge, PLC

(57) ABSTRACT

The invention relates to a knitting device for making a double-sided textile comprising two outer laps (1,2) that are knitted and joined to one another by means of a ground yarn (4). This device comprises two groups of needles (6) that move in translation on a respective needle bed (5) following a continuous rectilinear trajectory in a respective plane (P1, P2). The positions of the hook (7) of a needle (6) of at least one group respectively between its knitting station and its bonding station are situation on both sides of the intersecting straight line (D) between said two planes (P1, P2). In addition, the lift of the needle (6) between its knitting removal station is less than the lift of the needle (6) between its removal station and its bonding station.

14 Claims, 4 Drawing Sheets

U.S. PATENT DOCUMENTS

2004/0216496 A1* 11/2004 Willmer ..... 66/8

FOREIGN PATENT DOCUMENTS

EP 0 906 462 B1 4/1999

WO WO 01/68963 A1 9/2001

WO WO 02/064870 A1 8/2002

WO WO 03/042441 A1 5/2003

* cited by examiner

KNITTING DEVICE FOR MAKING A THICK DOUBLE-SIDED TEXTILE

BACKGROUND OF THE INVENTION

The present invention relates to the textile industry field and more particularly to knitting devices, which can be either flat or circular, with independent moving needles. The object of the invention is to provide one such device organized to achieve a double-sided technical knitted fabric of large thickness.

STATE OF THE ART

Knitting devices are known designed for making double-sided technical textiles used in particular in the upholstery, decoration and/or furnishing field. Technical textiles of this kind present the particularity of being relatively thick, and even of comprising zones of different thicknesses. Among these textiles, those formed by a double-sided fabric associated with two knitted outer laps joined to one another by at least one ground yarn are known. The ground yarn is designed to give the knitted fabric its thickness by maintaining a set distance between the outer laps. To obtain a variation of thickness of the knitted fabric, it is known to use a heat-shrink ground yarn so that the knitted fabric presents an outline comprising zones of different thickness depending on the nature of the heat treatment applied locally in these zones. It is also known to use several ground yarns presenting different retraction characteristics when subjected to the same heat treatment. Reference can in particular be made to the documents WO03/042441 (TEXTILES PLASTIQUES CHOMARAT et al.) and WO02/064870 (TEXTILES PLASTIQUES CHOMARAT) which describe knitted fabrics of this kind.

The knitting devices for making these textiles are of the flat type or circular type. These knitting devices in general implement a double needle bed, each needle bed supporting a group of needles mounted independently mobile on the needle bed which supports them. The needles of each of the groups are of the hook and pivoting latch type which are successively operated by operating means of the cam-based mechanism type or a similar mechanism. The needles of each of the groups assigned to a needle bed are designed to knit a respective knitting yarn to form one of the outer laps of the double-sided fabric. When this knitting takes place, the needles of each of the groups pick up the ground yarn to join the outer laps, a row of stitches of which has been knitted, to one another. At least in the yarn pick-up, knitting and/or joining zone, the needles of one of the groups are oriented and are mounted mobile on the corresponding needle bed in a plane that is orthogonally secant to the plane of orientation and mobility of the needles of the other group. These arrangements are such that the needles of one and the other of the groups are alternately moved to pick up the knitting and ground yarns in said pick-up zone following concurrent trajectories respectively comprised in said secant planes. More particularly, the travel performed by the needles of a group on the corresponding needle bed extends beyond the intersecting line between the secant planes to pick up the knitting yarn that is assigned to it and/or the ground yarn. Such a machine is described in the document US 2004/0216496.

The textile obtained presents a thickness typically of about a few millimeters. It has become apparent from usage that such a thickness may prove insufficient and in particular that these knitting devices did not enable double-sided textiles of more consequent thickness to be produced, i.e. more than about eight millimeters. This is why it was proposed to interpose a layer of foam between two knitted outer laps, this foam layer being stuck against these outer laps to bind the latter to one another. Such textiles are able to present a thickness of more than ten millimeters. However, implementation of such a technique does not enable a thick textile to be produced with satisfactory production rates. Moreover, the stability of thickness of the textile obtained is random and upkeep of the latter is difficult due to the presence of the foam layer stuck between the two outer laps.

OBJECT OF THE INVENTION

The general object of the invention is to propose a device for producing a thick textile of the double-sided knitted type whereby such a textile can be obtained with optimum production rates, the textile obtained being reliable as far as keeping the thickness it was initially given is concerned, and being easy to upkeep. What is to be understood by thick textile is a textile able to present a thickness of more than some ten millimeters, in particular fifteen millimeters or more.

The object of the present invention is more particularly to propose a knitting device, which may be either flat or circular, enabling a double-sided fabric to be produced comprising two outer laps joined to one another by at least one ground yarn giving the fabric its thickness, this knitted fabric being able to be obtained with high production rates, and nevertheless being able to present a consequent thickness, for example purposes about more than ten or fifteen millimeters. It is a further object of the invention to enable production of such a thick textile the outer laps whereof are able to present a complex structure, and also wherein feed of the ground yarns with the laps is variable.

The device of the present invention is a knitting device for producing a double-sided textile comprising two knitted outer laps joined to one another by at least one ground yarn. This device comprises two groups of needles with hook and pivoting needle latch which are respectively supported by a needle bed. The needles are mounted independently mobile on the corresponding needle bed following a straight trajectory between at least one removal station, a knitting station in which the hook of the needle picks up the corresponding knitting yarn, and a bonding station in which the hook of the needle picks up the ground yarn. The device further comprises means for moving the needles of each of the groups between their different stations, and feed means for performing feeding of the knitting yarns respectively forming one and the other of the outer laps, and of a ground yarn, to a zone of the pick-up device of these yarns by the hooks of the needles. The trajectory of a needle of a group is contained in a plane concurrent to a plane containing the trajectory of a needle of the other group in said yarn pick-up zone.

According to the present invention, such a device is mainly recognizable in that the positions of the hook of a needle of at least one group respectively between its knitting station and its bonding station are arranged on each side of the intersecting line between said two secant planes. Moreover, the travel of the needle between its removal station and its knitting station is smaller than the travel of the needle between its removal station and its bonding station.

According to a preferred embodiment, the needles of each of the groups respectively between their knitting station and their bonding station are arranged on each side of the intersecting line between said two secant planes.

These arrangements are such that the travel performed by a needle between its removal station and its knitting station is smaller than the distance separating the hook of the needle in the removal station and the position of said intersecting line. This results in the travels performed by the needles of a respective group to their respective knitting stations in no case being concurrent along their respective plane of travel. It finally results therefrom that pick-up of the knitting yarn by the needles of one or the other of the groups takes place before said intersecting line without crossing of the needles with respect to this line. It results from these arrangements that the outer laps are respectively knitted at a distance from one another with respect to said intersecting line, which enables a large clearance to be arranged between these knitted laps, a clearance which can be up to 17 mm.

Preferably, in the bonding station, a needle, its hook and the end of the needle latch in the open position are arranged on each side of said intersecting line.

According to a preferred embodiment, the device comprises means for guiding the knitted outer laps against a ramp arranged on the corresponding needle bed.

These means for guiding are preferably formed by a plate, of triangular or similar shape for example, comprising two edges which form respective guides of the knitted laps that are removed to the ramp of the corresponding needle bed. This plate more particularly presents the shape of a right-angled triangle the orthogonal sides of which form the guides being respectively oriented in a direction substantially parallel to the trajectories of the needles. This plate is in particular fitted between the needle beds with its right angle directed towards said intersecting line.

The needle bed advantageously comprises a bearing zone of the stitches of the corresponding outer lap. This bearing zone is arranged at the base of the ramp and at the end of the corresponding guide of the means for guiding. These arrangements are such that the stitching is held against the bearing zone which the needle bed comprises for passage of the hooked ground yarn when the needle returns to the removal station and the stitching is released by the needle.

Said bearing zone is for example formed from an additional plate added onto the corresponding needle bed.

According to an advantageous embodiment, the means for guiding further form a weft winder of at least one additional yarn distributed in the strands of the ground yarn joining one knitted outer lap to the other knitted outer lap.

The feed means preferably comprise means for guiding the corresponding knitting yarn in a direction inclined by an angle A1 smaller than or equal to 90° with respect to the trajectory of the needle of the corresponding group limited between its removal station and its knitting station. This angle A1 is more particularly an angle of 45°.

Furthermore, the feed means preferably comprise means for guiding the ground yarn in a direction inclined by an angle A2 greater than 90° with respect to the trajectory of the needles of one and the other group. This angle A2 is more particularly an angle of 135°.

It is apparent from these arrangements that the orientations towards the yarn pick-up zone respectively of the knitting yarns and of the ground yarn are concurrent, forming an angle more particularly of 90°.

According to an alternative embodiment, the feed means further comprise means for feeding at least one complementary yarn, such as a plaiting, plush loop or similar yarn, to the yarn pick-up zone, to be integrated in a corresponding outer lap.

More particularly, the feed means comprise means for guiding the complementary yarn in a direction substantially parallel to that of guiding of the corresponding knitting yarn.

The device of the invention is able to be applied indifferently to a device of flat type or of circular type. According to the organization of a device of flat type, the needles of any one group are for example arranged on a plate parallel to one another in the same plane.

According to the organization of a device of circular type, the needles of two groups are for example supported at the periphery of two cylinders rotating around one and the same axis.

A manufacturing cycle comprising a complete row comprises at least two main steps. A first step consists in implementing the ground yarn by crossing of the needles of each of the groups moved to the bonding station. Then in a second step, the outer laps are knitted by moving the corresponding needles to the knitting station, without their travel crossing the work zone of the needles in the bonding station and without their travel crossing the work zone of the other group in the knitting station.

Due to the provisions of the invention, the textile produced is thick and is obtained at high production rates. The outer laps are able to be of complex structure, such as of jersey, jacquard or structured meshes, a weft being able to be integrated in the strands of ground yarn joining the outer laps to one another, plush loops or a plaiting being able to be integrated in the outer laps. The knitting and/or ground yarns are indifferently monofilament or multifilament yarns of natural or synthetic origin.

DESCRIPTION OF THE DRAWINGS

The present invention will be more easily understood and details relating thereto will become more clearly apparent on reading the following description made in relation with the figures of the accompanying drawings, in which.

DESCRIPTION OF AN EMBODIMENT OF THE INVENTION

Figure 1:
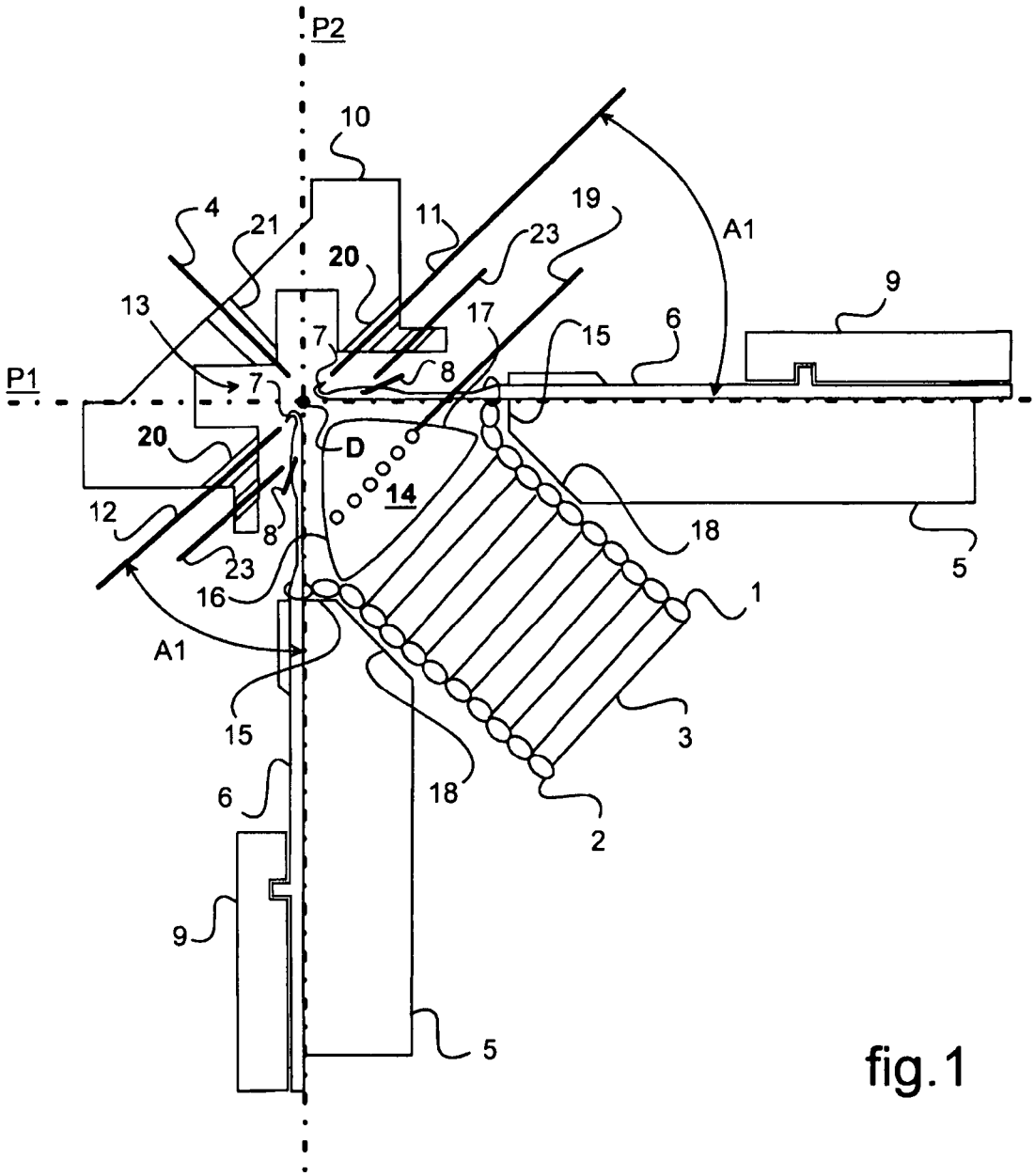
FIG. 1 is a diagram illustrating an embodiment of a knitting device of the present invention.
Figure 2:
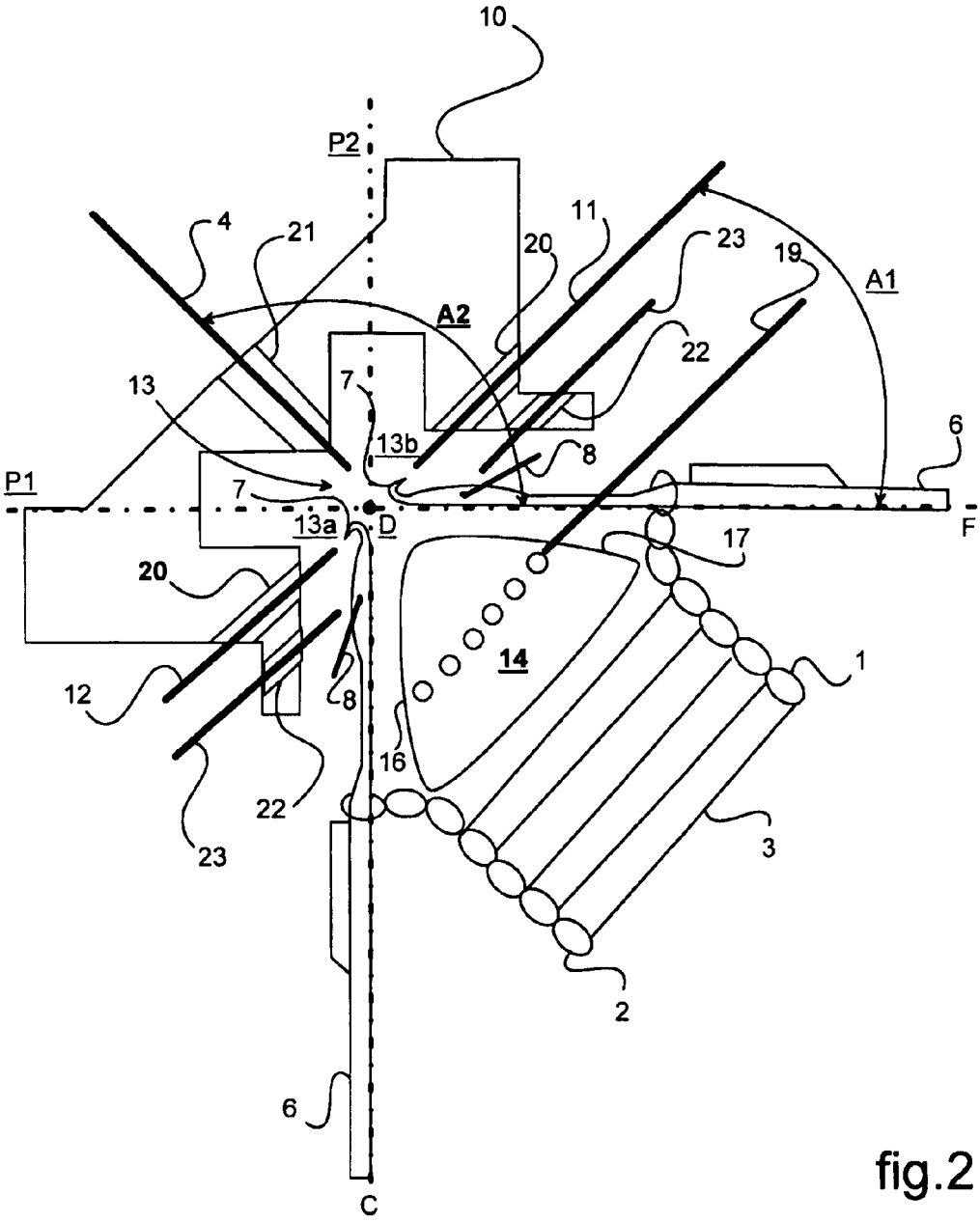
FIG. 2 is a detail of FIG. 1.

In FIG. 1 and FIG. 2, a knitting device is designed for manufacture of a double-sided textile composed of outer laps 1 and 2 joined to one another by strands 3 of a ground yarn 4. This device comprises a couple of systems, in the form of a cylinder and dial plate for example, that are each associated with a needle bed 5 supporting a plurality of needles 6 with hook 7 and pivoting needle latch 8 in mobile manner. These needles 6 are able to be operated independently in translation on needle bed 5 which supports them by operating means 9 of cam or similar type. The device further comprises feed means 10 for feeding knitting yarns 11 and 12 for manufacture respectively of one and the other of outer laps 1 and 2, and for feeding ground yarn 4. This results in the device comprising two groups of needles 6 mounted mobile in translation on their respective needle beds 5, each of these groups of needles 6 being designed for knitting a corresponding outer lap 1 or 2 and for picking up ground yarn 4 to join one of these outer laps 1,2 to one another by means of their stitching meshes.

Figure 3:
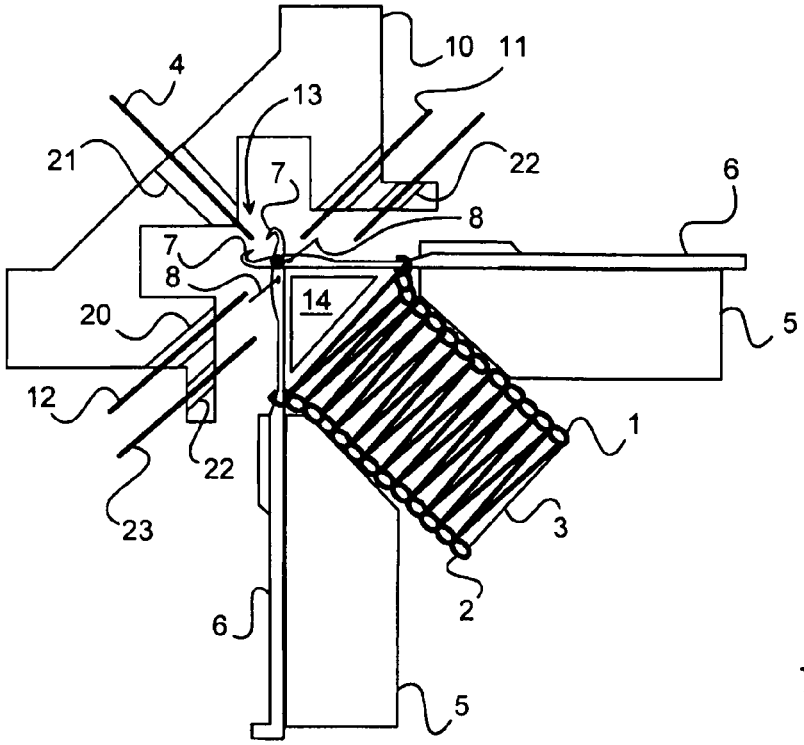
FIG. 3 to FIG. 6 are diagrams illustrating a device represented in FIG. 1, in different respective positions of the needles which it comprises.
Figure 4:
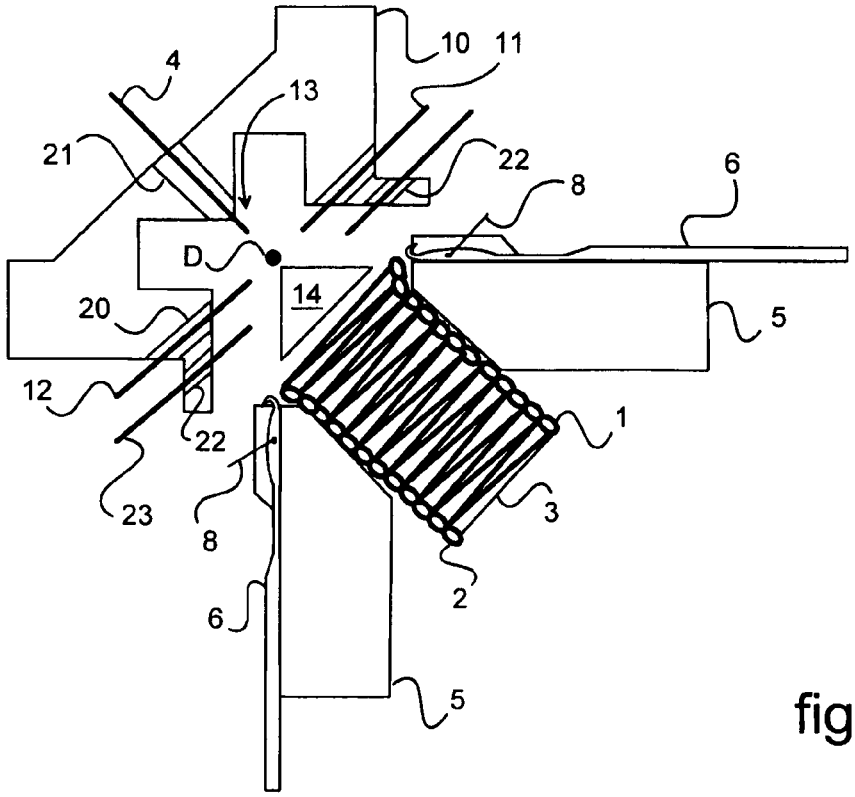
Figure 5:
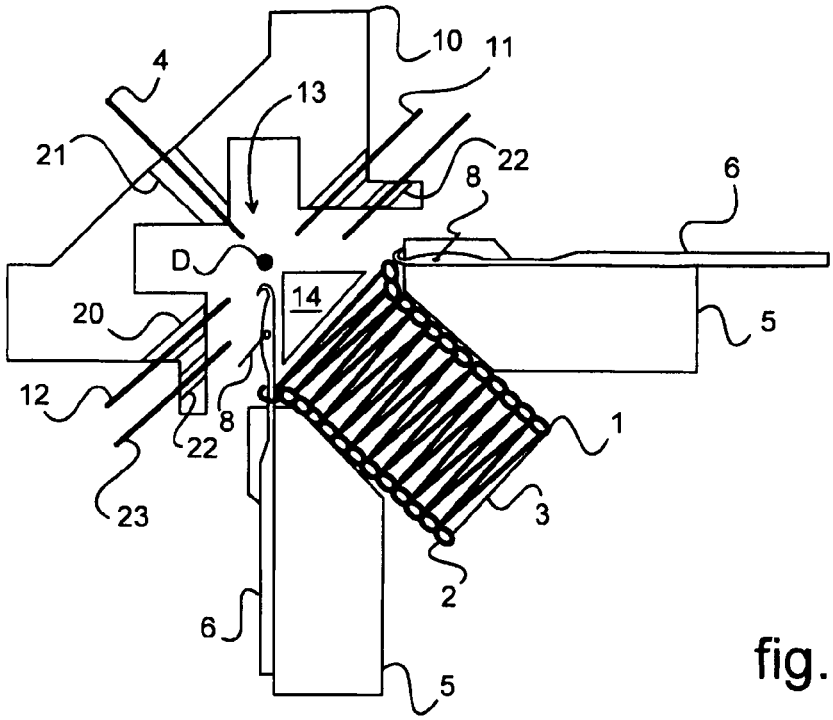
Figure 6:
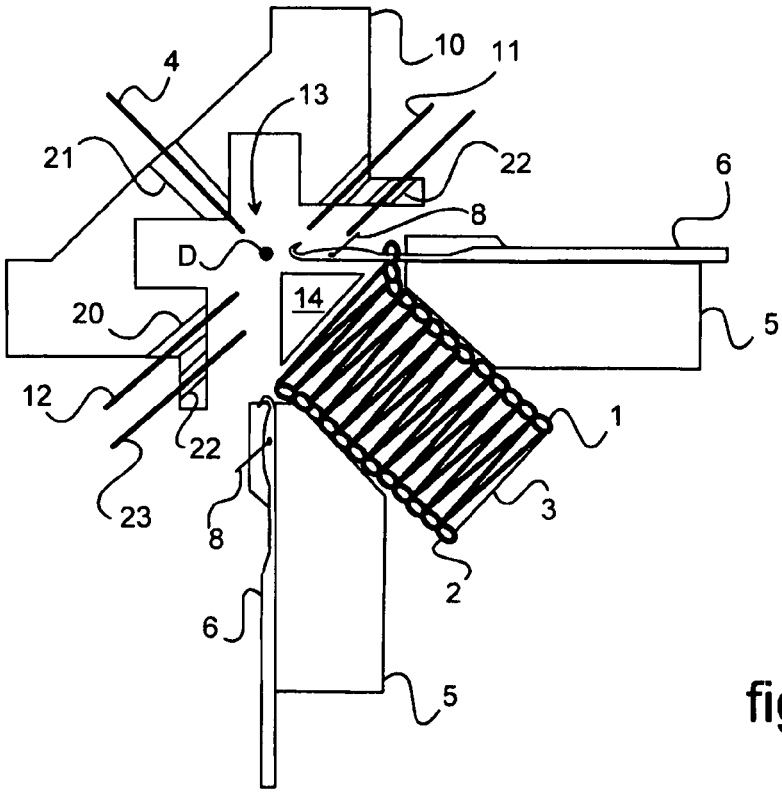

Needles 6 are mounted mobile in translation on needle bed 5 which supports them with a trajectory contained in respective planes P1 and P2, in the pick-up zone 13 of yarns 4,11,12 by needles 6. Planes P1 and P2 containing the trajectories of needles 6 respectively of one and the other of the groups are concurrent following an intersecting line D situated in pick-up zone 13 of yarns 4,11,12 by needles 6. It can be understood that in the figures, this intersecting line D is orthogonal to the plane of the confection sheet. Referring moreover to FIG. 3 to FIG. 6, needles 6 are mobile between different stations, including at least:

- a removal station, as illustrated in FIG. 4, and in FIG. 5 and FIG. 6, for needles 6 of a respective first and second group,
- a knitting station in which hooks 7 of needles 6 pick up knitting yarns 11,12, as represented in FIG. 5 and FIG. 6 for needles 6 of a respective second and first group,
- a bonding station in which hooks 7 of needles 6 pick up ground yarn 4, as illustrated in FIG. 3.

In FIG. 2 more particularly, yarn pick-up zone 13 is subdivided into two spaces 13*a* and 13*b* assigned to pick-up of the yarns by a corresponding group of needles 6. These spaces 13*a* and 13*b* are notably respectively contained in the volume delineated between P1, C and D for space 13*a*, and in the volume delineated between P2, F and D for space 13*b*.

Comparing the stations of needles 6 of FIG. 2 to FIG. 3, the positions of hook 7 of a needle 6 of a group respectively between its knitting station, as can be seen in FIG. 2, and its bonding station, as can be seen in FIG. 3, are arranged on each side of the intersecting line D between the concurrent planes P1 and P2 containing the trajectory of needles 6 respectively of one and the other group. The travel of needles 6 between their removal station and their knitting station is smaller than the travel of needles 6 between their removal station and their bonding station. More particularly, when ground yarn 4 is picked up by needles 6, the travel of the latter extends beyond said intersecting line D, whereas the travel of needles 6 to their knitting position is limited to prevent hook 7 from going beyond intersecting line D. This results in the respective trajectories of hooks 7 of needles 6 of one and the other of the groups to their knitting station not crossing. Furthermore in FIG. 3, in the bonding station, needles 6, their hook 7 and the end of needle latches 8 which they comprise are in the open position arranged on each side of said intersecting line D.

Referring back more particularly to FIG. 1 and FIG. 2, the device comprises means for guiding 14 knitted outer laps 1,2, and more particularly the stitches of the row being formed. These means for guiding 14 guide the stitches to a bearing zone 15 of the stitches arranged on the corresponding needle bed 5. This bearing zone 15 is designed to hold the stitching secure when the latter goes beyond needle 6 and ground yarn 4 passes therethrough. Means for guiding 14 are formed by a plate of general triangular shape, or in a general manner in the form of a preferably right-angled dihedron the edges of which are preferably rounded and polished. This plate is placed between the two needle beds 5. The edges forming said right angle constitute respective guides 16 and 17 of the knitted stitching removed to a ramp 18 forming part of the corresponding needle bed 5. These guides 16, 17 are substantially oriented in a direction parallel to the trajectory of corresponding needles 6 in yarn pick-up zone 13. This results in means for guiding 14 preventing the stitches from moving up towards the line D, the stitches being held securely by bearing zone 15 which is arranged at the base of ramps 18, at the end of the corresponding guide 16,17 of means for guiding 14.

These means for guiding 14 are further able to be used to form a weft winder of at least one additional yarn 19 distributed in strands 3 of ground yarn 4 joining outer laps 1,2 to one another. Yarn feed means 10 comprised in the device comprise means for feeding such an additional yarn 19 to means for guiding 14.

Yarn feed means 10 comprise means for guiding 20 knitting yarns 11,12 in a direction inclined by an angle A1 of about 45° with respect to the trajectory of needles 6 to their knitting station. Furthermore, yarn feed means 10 comprise means for guiding 21 ground yarn 4 in a direction inclined by an angle A2 of about 135° with respect to the trajectory of needles 6 of one and the other of the groups. Accessorily, feed means 10 comprise means for feeding at least one complementary yarn 23 to yarn pick-up zone 13 to integrate this complementary yarn 23 in one and/or the other of outer laps 1,2. More particularly, means for guiding 22 this complementary yarn 23 feed the yarn pick-up zone for the purposes of integrating this complementary yarn 23 within a corresponding outer lap 1,2. Complementary yarn 23 is in particular guided to yarn pick-up zone 13 in a direction substantially parallel to that of corresponding knitted yarn 11,12. The device is able to comprise means for guiding 22 a complementary yarn respectively assigned to one and the other of outer laps 1 and 2, one of the complementary yarns 23 being able to be a plaiting yarn integrated in one of the outer laps 1, the other complementary yarn 23 being able to be a yarn for forming plush loops integrated in the other outer lap 2.

An embodiment of implementation of the device of the invention consists in moving needles 6 of one and the other of the groups to the bonding station to pick up ground yarn 4, as represented in FIG. 3. In FIG. 4 to FIG. 6, needles 6 are placed in the knitting cycle station of yarns 11 and 12 to form outer laps 1 and 2. During this knitting cycle of yarns 11 and 12, needles 6 of the two groups do not go beyond intersecting line D.

The invention claimed is:

1. A knitting device for producing a double-sided textile comprising two knitted outer laps joined to one another by at least one ground yarn, said device comprising:

- two groups of needles with hook and pivoting needle latch which are respectively supported by a needle bed,
- the needles being mounted independently mobile on the corresponding needle bed following a straight trajectory between at least one removal station, a knitting station in which the hook of the needle picks up a corresponding knitting yarn, and a bonding station in which the hook of the needle picks up the ground yarn,
- means for moving the needles of each of the groups between their different stations,
- feed means for performing feeding of the knitting yarns respectively forming one and the other of the outer laps, and of a ground yarn, to a zone of the pick-up device of these yarns by the hooks of the needles, the trajectory of a needle of a group being contained in a plane concurrent to a plane containing the trajectory of a needle of the other group in said yarn pick-up zone,
- wherein the positions of the hook of a needle of a group respectively between its knitting station and its bonding station are arranged on each side of the intersecting line between said two planes, and the travel of the needle between its removal station and its knitting station is smaller than the travel of the needle between its removal station and its bonding station.

2. The knitting device according to claim 1, wherein the needles of each of the groups respectively between their knitting station and their bonding station are arranged on each side of the intersecting line between said two planes.

3. The knitting device according to claim 1, wherein, in the bonding station, a needle, its hook and the end of the needle latch in the open position are arranged on each side of said intersecting line.

4. The knitting device according to claim 1, comprising means for guiding the knitted outer laps against a ramp arranged on the corresponding needle bed.

5. The knitting device according to claim 4, wherein the means for guiding are formed by a plate comprising two edges which form respective guides of the knitted laps that are removed to the ramp of the corresponding needle bed.

6. The knitting device according to claim 4, wherein the needle bed comprises a bearing zone of the stitching of the corresponding outer lap, which is arranged at the base of the ramp and at the end of the corresponding guide of the means for guiding for passage of the hooked ground yarn when the needle returns to the removal station and the stitching is released by the needle.

7. The knitting device according to claim 6, wherein said bearing zone is formed from an additional plate added onto the corresponding needle bed.

8. The knitting device according to claim 4, wherein the means for guiding further form a weft winder of at least one additional yarn distributed in the strands of the ground yarn joining a knitted outer lap to the other knitted outer lap.

9. The knitting device according to claim 1, wherein the feed means comprise means for guiding the corresponding knitting yarn in a direction inclined by an angle smaller than or equal to 90° with respect to the trajectory of the needle of the corresponding group limited between its removal station and its knitting station.

10. The knitting device according to claim 1, wherein the feed means comprise means for guiding the ground yarn in a direction inclined by an angle greater than 90° with respect to the trajectory of the needles of one and the other group.

11. The knitting device according to claim 1, wherein the feed means comprise means for feeding at least one complementary yarn to the yarn pick-up zone to be integrated in a corresponding outer lap.

12. The knitting device according to claim 11, wherein the feed means comprise means for guiding the complementary yarn in a direction substantially parallel to that of guiding of the corresponding knitting yarn.

13. The knitting device according to claim 1, wherein it is of the flat type, the needles of any one group being arranged on a plate parallel to one another in the same plane.

14. The knitting device according to claim 1, wherein it is of the circular type, the needles of two groups being supported at the periphery of two cylinders rotating around one and the same axis.

* * * * *